US005724900A

United States Patent [19]

Tratz

[11] Patent Number: 5,724,900

[45] Date of Patent: Mar. 10, 1998

[54] METHOD AND PLANT FOR CARBONIZING AND BURNING WASTE

[75] Inventor: Herbert Tratz, Ottensoos, Germany

[73] Assignee: Siemens Aktiengesellschaft, Muenchen, Germany

[21] Appl. No.: 458,489

[22] Filed: Jun. 2, 1995

[30] Foreign Application Priority Data

Jun. 10, 1994 [DE] Germany ..... 44 20 420.5

[51] Int. Cl.[6] ..... F23G 5/027

[52] U.S. Cl. ..... 110/346; 110/229; 110/246; 110/259

[58] Field of Search ..... 110/204, 229, 110/230, 233, 237, 246, 346; 588/201, 257

[56] References Cited

U.S. PATENT DOCUMENTS

| | | | |
|---|---|---|---|
| 4,541,345 | 9/1985 | Grumpelt et al. | 110/246 X |
| 4,797,091 | 1/1989 | Neumann | 110/229 X |
| 4,815,398 | 3/1989 | Keating, II et al. | 110/233 |
| 4,878,440 | 11/1989 | Tratz et al. | 110/233 |
| 5,123,364 | 6/1992 | Gitman et al. | 110/233 X |
| 5,501,160 | 3/1996 | Goldman et al. | 110/229 |

FOREIGN PATENT DOCUMENTS

| | | |
|---|---|---|
| 3633212 | 4/1988 | Germany . |
| 3811820 | 2/1989 | Germany . |
| 3730729 | 3/1991 | Germany . |
| 41 02 255 | 8/1991 | Germany . |

OTHER PUBLICATIONS

Tischvorlage der SBW: zum Thema "Behandlungsverfahren", pp. 1–20 Jun. 1993.

*Primary Examiner*—Henry A. Bennett
*Assistant Examiner*—Susanne C. Tinker
*Attorney, Agent, or Firm*—Herbert L. Lerner; Laurence A. Greenberg

[57] ABSTRACT

A method for processing waste includes low-temperature carbonizing one portion of the waste creating low-temperature carbonization gas and low-temperature carbonization residue. A carbon-rich fraction is separated off from the low-temperature carbonization residue. At least some of the carbon-rich fraction of the low-temperature carbonization residue is supplied as fuel for a support flame for burning another portion of the waste. A plant for processing waste includes a revolving tubular kiln in which a burner is disposed. A low-temperature carbonization drum has an outlet side communicating with a low-temperature carbonization gas line and a separator device for solid low-temperature carbonization residue. A line carries a carbon-rich fraction of the low-temperature carbonization residue from the separator device to the burner.

9 Claims, 1 Drawing Sheet

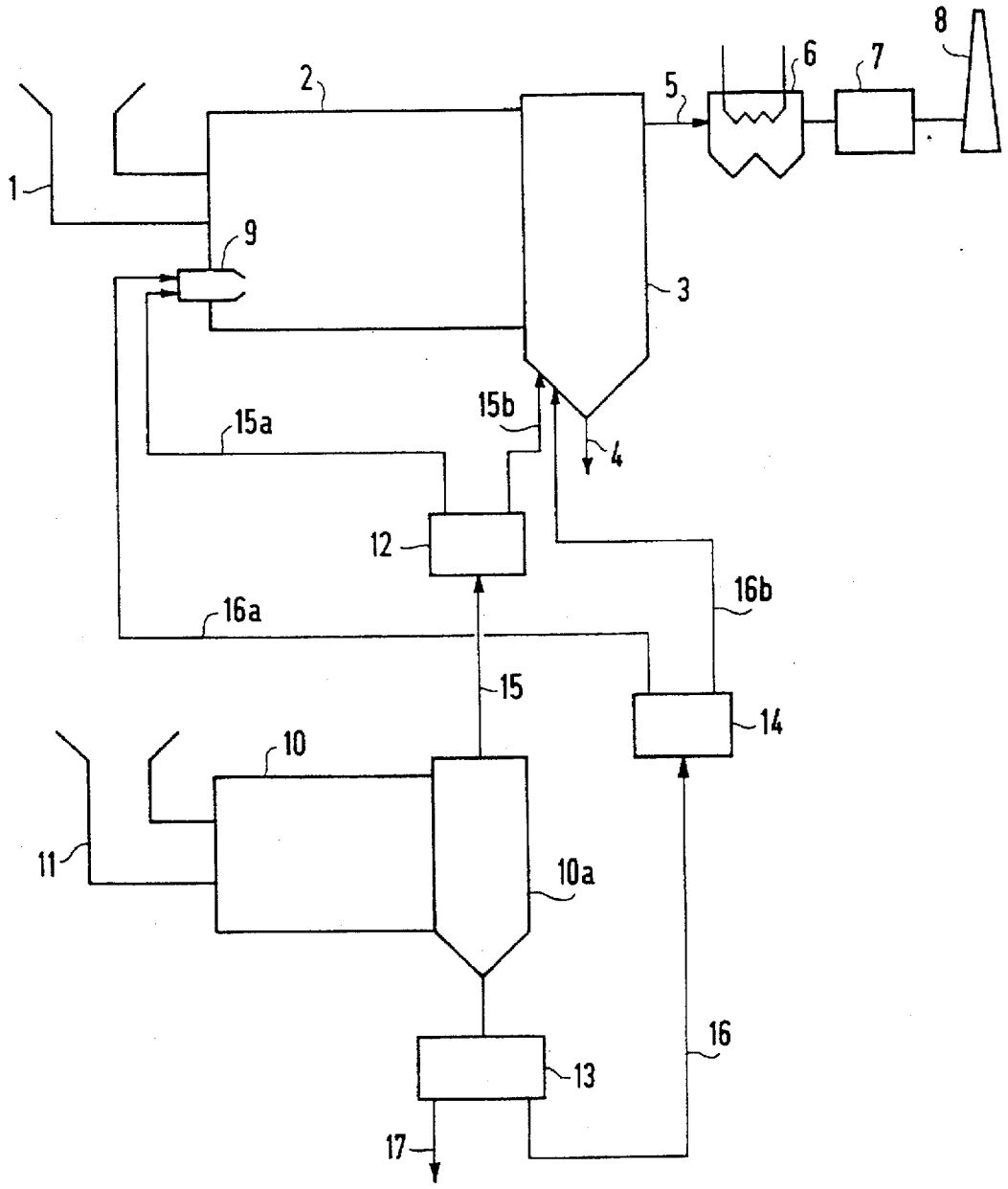
1
2
3
4
5
6
7
8
9
10
10a
11
12
13
14
15
15a
15b
16
16a
16b
17

METHOD AND PLANT FOR CARBONIZING AND BURNING WASTE

BACKGROUND OF THE INVENTION

Field of the Invention

The invention relates to a method for processing waste, in which one portion of the waste is carbonized at low temperature, creating low-temperature carbonization gas and low-temperature carbonization residue, and in which a carbon-rich fraction is separated off from the low-temperature carbonization residue.

The invention also relates to a plant or system for processing waste, having a revolving tubular kiln in which a burner is disposed, a low-temperature carbonization drum which communicates on the outlet side with a low-temperature carbonization gas line and with a separator device for solid low-temperature carbonization residue, and a line for a carbon-rich fraction of the low-temperature carbonization residue which originates at the separator.

A plant for processing waste, in which one portion of the waste being delivered is charged into a revolving tubular kiln and another portion is charged into a low-temperature carbonization drum, is known from a handout that was distributed by the firm SBW (Sonderabfallentsorgung Baden-Württemberg GmbH) on the subject of "Treatment Processes" and presented at the "Forum Sonderabfallwirtschaft des Landes Baden-Württemberg" [Forum on Hazardous Waste Handling in the German State of Baden-Württemberg] in June 1993. In the plant shown on page 12 thereof, some of the waste is carbonized at low temperature. The low-temperature carbonization gas is employed as an energy vehicle for burning the remainder of the waste. The low-temperature carbonization residue occurring in the low-temperature carbonization process is fractionated, and in the process metals and other inert components are separated out separately. A remaining carbon-rich fraction of the low-temperature carbonization residue is then admixed with the waste being delivered, in order to raise the calorific value thereof.

In the known plant, the carbon-rich fraction of the low-temperature carbonization residue is fed together with waste directly into the revolving tubular kiln and burned there. A correspondingly large revolving tubular kiln must therefore be provided. In particular, because of the high throughput, maintenance or even replacement of the revolving tubular kiln must be performed frequently.

SUMMARY OF THE INVENTION

It is accordingly an object of the invention to provide a method and a plant for processing waste, which overcome the hereinafore-mentioned disadvantages of the heretofore-known methods and devices of this general type and which enable a markedly longer service life and fewer maintenance sessions for a revolving tubular kiln.

With the foregoing and other objects in view there is provided, in accordance with the invention, a method for waste processing, which comprises low-temperature carbonizing one portion of waste to be processed creating low-temperature carbonization gas and low-temperature carbonization residue; separating off a carbon-rich fraction from the low-temperature carbonization residue; and supplying at least some of the carbon-rich fraction of the low-temperature carbonization residue as fuel for a support flame for burning another portion of the waste.

The carbon-containing fraction of the low-temperature carbonization residue as well as the low-temperature carbonization gas are used directly as fuel for the support flame, which is necessary to enable burning waste with a low calorific value, which as a rule is hazardous waste. Since the carbon-rich fraction is used as fuel and not to raise the calorific value of waste, it puts less of a burden on the revolving tubular kiln, and the maintenance sessions of the revolving tubular kiln can be curtailed. Moreover and advantageously, other fuel is spared that would otherwise be needed to heat the revolving tubular kiln. Neither natural gas nor heating oil need be used.

In accordance with another mode of the invention, in the event that there is more low-temperature carbonization gas and carbon-rich components of the low-temperature carbonization residue available than is needed for the support flame, then the remainder of the low-temperature carbonization gas and the remainder of the carbon-rich fraction can be burned. This burning can be performed in an afterburning chamber downstream of the revolving tubular kiln.

This has the advantage of eliminating excess low-temperature carbonization gas and excess carbon-containing low-temperature carbonization residue components in the afterburning chamber, thus circumventing the revolving tubular kiln. Due to the lower throughput, it is advantageously possible to make do with a small, economical revolving tubular kiln. Moreover, the expense for maintenance of the revolving tubular kiln is reduced. Burning the excess substances in the afterburning chamber can be carried out with simple devices, since the afterburning chamber has no rotating structural parts.

By way of example, the waste to be disposed of is presorted in such a way that typical household garbage, which has a high calorific value, is carbonized at low temperature, while hazardous waste, having a calorific value which is low, is burned in the revolving tubular kiln. Hazardous waste containers, such as barrels, can be fed unopened directly into the very large revolving tubular kiln. The requisite heating of the revolving tubular kiln is performed with low-temperature carbonization gas and carbon-containing low-temperature carbonization residue from the low-temperature carbonization process, which are furnished from household garbage specifically for this purpose by using a low-temperature carbonization drum. Excess low-temperature carbonization gas and excess carbon-rich low-temperature carbonization residue components can be burned in the afterburning chamber, without burdening the revolving tubular kiln.

With the objects of the invention in view, there is also provided a plant for processing waste, comprising a revolving tubular kiln; a burner disposed in the revolving tubular kiln; a low-temperature carbonization drum having an outlet side; a low-temperature carbonization gas line communicating with the outlet side of the low-temperature carbonization drum; a separator device for solid low-temperature carbonization residue communicating with the outlet side of the low-temperature carbonization drum; and a line carrying a carbon-rich fraction of the low-temperature carbonization residue from the separator device to the burner in the revolving tubular kiln.

The carbon-rich fraction of the low-temperature carbonization residue is used directly to heat the revolving tubular kiln.

Since the carbon-rich fraction is not fed together with the waste into the revolving tubular kiln, the revolving tubular kiln is less severely burdened and needs maintenance less often.

In accordance with another feature of the invention, the low-temperature carbonization gas line that originates at the low-temperature carbonization drum is also connected with the burner in the revolving tubular kiln. The fuel for this burner can accordingly be low-temperature carbonization gas and/or carbon-containing low-temperature carbonization residue. Advantageously, no external fuel such as natural gas will therefore be needed.

In accordance with a further feature of the invention, the low-temperature carbonization gas line and/or the line for the carbon-rich fraction of the low-temperature carbonization residue communicate not only with the burner in the revolving tubular kiln but also directly with an afterburning chamber downstream of the revolving tubular kiln.

This has the advantage of eliminating low-temperature carbonization gas and carbon-rich low-temperature carbonization residue that are not needed as fuel, in a simple way in the afterburning chamber, without burdening the revolving tubular kiln. Complete combustion of these substances is possible in the afterburning chamber.

In accordance with an added feature of the invention, the low-temperature carbonization gas line and/or the line for the carbon-rich fraction communicate with controllable distributor devices, which communicate with the burner through first line branches and with the afterburning chamber through second line branches. It is thus advantageously possible for the low-temperature carbonization gas and the carbon-rich fraction of the low-temperature carbonization residue to be distributed to the burner and the afterburning chamber in such a way that the burner always receives an optimal amount of fuel.

In accordance with a concomitant feature of the invention, a first garbage charging device for household garbage, which communicates with the inlet to the low-temperature carbonization drum, and a second garbage charging device for a hazardous waste, which communicates with the inlet to the revolving tubular kiln, are present. This has the advantage of eliminating the hazardous waste in the revolving tubular kiln and in the downstream afterburning chamber, and of producing a fuel, which is intended for the burner of the revolving tubular kiln and which comes from household garbage, with the low-temperature carbonization drum.

In particular, the method and the plant of the invention attain the advantage of enabling household garbage and hazardous waste combined to be disposed of, without having to additionally purchase fuel for heating the hazardous waste. Moreover, by feeding excess low-temperature carbonization gas and carbon-rich low-temperature carbonization residue into the afterburning chamber, the throughput through the revolving tubular kiln is reduced enough to ensure that a small, economical revolving tubular kiln suffices, and moreover needs maintenance less often than a large revolving tubular kiln.

Other features which are considered as characteristic for the invention are set forth in the appended claims.

Although the invention is illustrated and described herein as embodied in a method and a plant for waste processing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure of the drawing is a schematic circuit diagram of a plant for waste processing, with which the method and the plant according to the invention will be described in further detail.

DESCRIPTION OF THE PREFERRED EMBODIMENTS

Referring now to the figure of the drawing in detail, there is seen a plant for disposing of hazardous waste. This waste can also be delivered in containers, such as barrels. The hazardous waste enters a revolving tubular kiln 2 through a first charging device 1. Both the charging device 1 and the revolving tubular kiln 2 are constructed to be large enough to ensure that the containers need not be opened. Entire filled barrels can be fed into the revolving tubular kiln 2. In the revolving tubular kiln 2, the temperature is approximately 1300° C. The revolving tubular kiln 2 discharges into an afterburning chamber 3, which does not rotate. There the temperature is approximately between 1200° C. and 1300° C. A slag discharge line 4 and a flue gas discharge line 5 lead away from the afterburning chamber 3. The slag and the flue gas are further processed in the usual manner. The flue gas can be carried through a waste heat boiler 6 in order to dissipate heat. From there, it passes through a flue gas scrubber 7 to a chimney 8. Since the hazardous waste has a very low calorific value, it must be heated in the revolving tubular kiln 2 by a burner 9 disposed there. A fuel must be supplied to this burner 9.

In order to ensure that no external fuel, such as natural gas, will be needed, a low-temperature carbonization drum 10 is present. Household garbage, which as a rule has a high calorific value, is carried through a second charging device 11 to the low-temperature carbonization drum 10. Low-temperature carbonization gas and solid low-temperature carbonization residue are formed in the low-temperature carbonization drum 10. The low-temperature carbonization gas is supplied through a low-temperature carbonization gas line 15 to a distributor device 12. Low-temperature carbonization gas is carried as fuel from the distributor device 12 through a first line branch **15*a* to provide a support flame in the burner 9. Remaining low-temperature carbonization gas reaches the afterburning chamber 3 directly from the distributor device 12, through a second line branch 15*b*. The low-temperature carbonization residue passes from a discharge housing 10*a* of the low-temperature carbonization drum 10 to a separator device 13. There, coarse components are separated from fine components, or fines, of the low-temperature carbonization residue. The course components are rocks, metals and other inert substances, which are expelled through a discharge outlet 17. They can be separated even further and recycled. The fines, which are rich in carbon, are delivered through a line 16 to a distributor device 14. From there, carbon-rich low-temperature carbonization residue is carried through a first line branch 16*a* as fuel to provide a support flame in the burner 9. Remaining carbon-rich low-temperature carbonization residue passes from the distributor device 14 through a second line branch 16*b* directly into the afterburning chamber 3. The distributor devices 12, 14 carry only as much fuel to the burner 9** as is needed there.

In addition to the burner 9 shown in the revolving tubular kiln 2, a similar non-illustrated burner, which may be located in the afterburning chamber 3, can also be supplied with low-temperature carbonization gas and carbon-rich low-temperature carbonization residue.

The advantage attained with the illustrated plant is that the heating energy necessary to dispose of hazardous waste is generated from household garbage, with the aid of a parallel-operated low-temperature carbonization drum 10. At the same time, it is possible to make use of the carbon-containing low-temperature carbonization residue. Since excess low-temperature carbonization residue, like excess low-temperature carbonization gas, which are not necessary for heating the hazardous waste, are fed directly into the afterburning chamber 3, a relatively small and therefore economical revolving tubular kiln 2, which only requires little maintenance, is sufficient.

I claim:

1. A method for waste processing, which comprises:

presorting waste into a first portion of household garbage and a second portion to be processed;

low-temperature carbonizing the first portion of household garbage and creating low-temperature carbonization gas and low-temperature carbonization residue;

separating off a carbon-rich fraction from the low-temperature carbonization residue;

burning the second portion of waste; and supplying at least some of a low-temperature carbonization gas and the carbon-rich fraction of the low-temperature carbonization residue formed in the low-temperature carbonization as fuel for a support flame for burning hazardous waste.

2. The method according to claim 1, which comprises burning a remainder of the carbon-rich fraction.

3. A plant for processing waste, comprising:

a revolving tubular kiln for receiving waste;

a burner disposed in said revolving tubular kiln;

said revolving tubular kiln being formed with an inlet for feeding a first portion of the waste into said kiln;

a low-temperature carbonization drum having an outlet side and being formed with an inlet for feeding a second portion of the waste into said drum;

a low-temperature carbonization gas line communicating with said outlet side of said low-temperature carbonization drum;

a separator device for solid low-temperature carbonization residue communicating with said outlet side of said low-temperature carbonization drum; and a line carrying a carbon-rich fraction of the low-temperature carbonization residue from said separator device to said burner in said revolving tubular kiln.

4. The plant according to claim 3, wherein said revolving tubular kiln has a first charging device for hazardous waste; said first charging device being connected to said inlet of said revolving tubular kiln; said low-temperature carbonization drum having a second charging device for household garbage; said second charging device being connected to said inlet of said low-temperature carbonization drum.

5. A plant for processing waste, comprising:

a revolving tubular kiln;

a burner disposed in said revolving tubular kiln;

a low-temperature carbonization drum having an outlet side;

a low-temperature carbonization gas line communicating with said outlet side of said low-temperature carbonization drum;

a separator device for solid low-temperature carbonization residue communicating with said outlet side of said low-temperature carbonization drum;

a line carrying a carbon-rich fraction of the low-temperature carbonization residue from said separator device to said burner in said revolving tubular kiln;

an afterburning chamber having an inlet;

said line for the carbon-rich fraction communicating with said inlet of said afterburning chamber as well as with said burner; and said revolving tubular kiln having an outlet side communicating with said afterburning chamber.

6. The plant according to claim 5, including a controllable distributor device being connected to said line for the carbon-rich fraction, a first line branch leading from said distributor device to said burner, and a second line branch leading from said distributor device to said afterburning chamber.

7. The plant according to claim 5, wherein said low-temperature carbonization gas line communicates with said burner in said revolving tubular kiln as well as with said inlet of said afterburning chamber.

8. The plant according to claim 7, including a controllable distributor device being connected to said low-temperature carbonization gas line; a first line branch leading from said distributor device to said burner; and a second line branch leading from said distributor device to said afterburning chamber.

9. A plant for processing waste, comprising:

a revolving tubular kiln;

a burner disposed in said revolving tubular kiln;

a low-temperature carbonization drum having an outlet side;

a low-temperature carbonization gas line communicating with said outlet side of said low-temperature carbonization drum;

a separator device for solid low-temperature carbonization residue communicating with said outlet side of said low-temperature carbonization drum; and a line carrying a carbon-rich fraction of the low-temperature carbonization residue from said separator device to said burner in said revolving tubular kiln, wherein said revolving tubular kiln and said low-temperature carbonization drum each have an inlet, and including a first charging device for hazardous waste communicating with said inlet of said revolving tubular kiln, and a second charging device for household garbage communicating with said inlet of said low-temperature carbonization drum.

* * * * *